United States Patent [19]

Kendall et al.

[11] Patent Number: 4,494,485

[45] Date of Patent: Jan. 22, 1985

[54] FIRED HEATER

[75] Inventors: Robert M. Kendall, Sunnyvale; Richard J. Schreiber, Mountain View, both of Calif.

[73] Assignee: Gas Research Institute, Chicago, Ill.

[21] Appl. No.: 554,438

[22] Filed: Nov. 22, 1983

[51] Int. Cl.[3] ..... F22B 21/00

[52] U.S. Cl. ..... 122/250 R; 122/184 D; 122/18; 431/328

[58] Field of Search ..... 122/14, 18, 19, 245, 122/250 R, 4; 431/328

[56] References Cited

U.S. PATENT DOCUMENTS

| | | | |
|---|---|---|---|
| 2,825,313 | 3/1958 | Born et al. | 122/354 |
| 3,182,638 | 5/1965 | Lee et al. | 122/240 |
| 3,221,711 | 12/1965 | Beggs | 122/240 |
| 3,265,043 | 8/1966 | Lee et al. | 122/360 |
| 3,302,621 | 2/1967 | Klein | 122/510 |
| 3,407,023 | 10/1968 | Hirschberg et al. | 431/328 |
| 3,445,175 | 5/1969 | Krieger | 431/328 |
| 3,563,211 | 2/1971 | Hornbostel | 122/250 R |
| 3,635,648 | 1/1972 | Morse et al. | 431/328 |
| 3,810,732 | 5/1974 | Koch | 431/328 X |
| 4,089,303 | 5/1978 | Brufert | 122/250 R |

*Primary Examiner*—Edward G. Favors

*Attorney, Agent, or Firm*—Flehr, Hohbach, Test, Albritton & Herbert

[57] ABSTRACT

A fired heater incorporating radiant tube sections in the combustion chamber. Radiant burners mounted in the chamber side walls combust reactants flamelessly and transfer thermal energy inwardly to the radiant section tubes. Certain of the embodiments include tube coils forming convection sections with gaseous products of combustion flowing in heat exchange relationship with the convection section tubes after which they are channeled into a flue.

15 Claims, 7 Drawing Figures

FIRED HEATER

This invention relates to apparatus and processes for heating fluids and in particular relates to fired heaters of the type used in petroleum, chemical and other industries. The invention has application in heaters for steam generation as well as hydrocarbon heating and petroleum refining such as high-temperature cracking of hydrocarbon gases, thermal polymerization of light hydrocarbons or hydrogenation of oils.

Heaters used in industry for steam generation and petroleum refining are known as fired heaters, process heaters, furnaces or process furnaces. The general service categories of the process industry requirements for refinery heaters include distillation column reboilers, fractionating column feed preheaters, reactor feed preheaters, supplying heat to a heat transfer medium, and fired reactors in which a chemical reaction occurs within a tube coil.

Conventional fired heater designs include both radiant and convection sections. The radiant section includes a combustion chamber in which the flame from burners heats the tube coils by radiation. The convection section, which typically is separate from the radiant section, includes convection coils which recover the residual heat of the flue gas. In certain fired heater designs known as the "all radiant" type, there is no separate convection section.

Heaters are principally classified by the orientation of the heating coil in the radiant section, which can be either a horizontal setting or a vertical setting. The horizontal setting for the tubes is typically used in rectangular cross-section designs, known as box or cabin type heaters. Vertical setting for the tubes is typically used in cylindrical crosssection heaters. Where heaters employ both radiant and convection sections, it is conventional to mount the convection coil above the radiant coil and in the path of the flue gas exhausting from the combustion chamber. Such a design, however, makes it more difficult and time consuming to repair or replace the tube runs of the radiant coil.

The heat source in the combustion chamber of conventional heaters typically comprises open flame burners mounted in the floor of the chamber with the tube rows arranged about the chamber sidewalls. This requires a relatively large size vessel for the combustion chamber because a large volume of heated gas is required to radiate to the tubes in the radiant section. In addition, these designs require mounting of the coils at a distance from the burners to avoid direct impingement of the flame on the metal of the tubes. Certain other burner designs employ radiant burners on opposite sides of a box-type chamber with radiant tubes in between, but no provision is made for a convection section, and because of the straight wall configuration the units are relatively large and expensive to build.

It is, accordingly, a principal object of the invention to provide a new and improved fired heater which obviates the disadvantages and limitations of conventional heater designs.

Another object is to provide a fired heater which combines radiant and convection coil sections into a single vessel of relatively compact size with resulting cost savings.

Another object is to provide a fired heater of the type described employing radiant ceramic fiber burners resulting in improved thermal efficiency, reduced emissions, a wide range of turn down capability, and low noise levels.

The invention in summary includes a fired heater of vertical setting configuration having a cylindrical side wall in which radiant burners are mounted. A bundle of tubes forming a radiant section is spaced inwardly from the burners. In one embodiment another bundle of tubes forming a convection section is mounted concentrically within the radiant section and in heat exchange relationship with the radially inward flow of products of combustion from the burners. In a further embodiment the tube bundles form an all radiant section spaced inwardly from the burners in the cylindrical wall. In another embodiment, a convection section is positioned in the path of flue gases flowing upwardly from the radiant section. Exhaust means is provided for directing the flow of combustion products from the chamber.

The foregoing and additional objects and features of the invention will appear from the following specification in which the several embodiments have been described in conjunction with the accompanying drawings.

Figure 1:
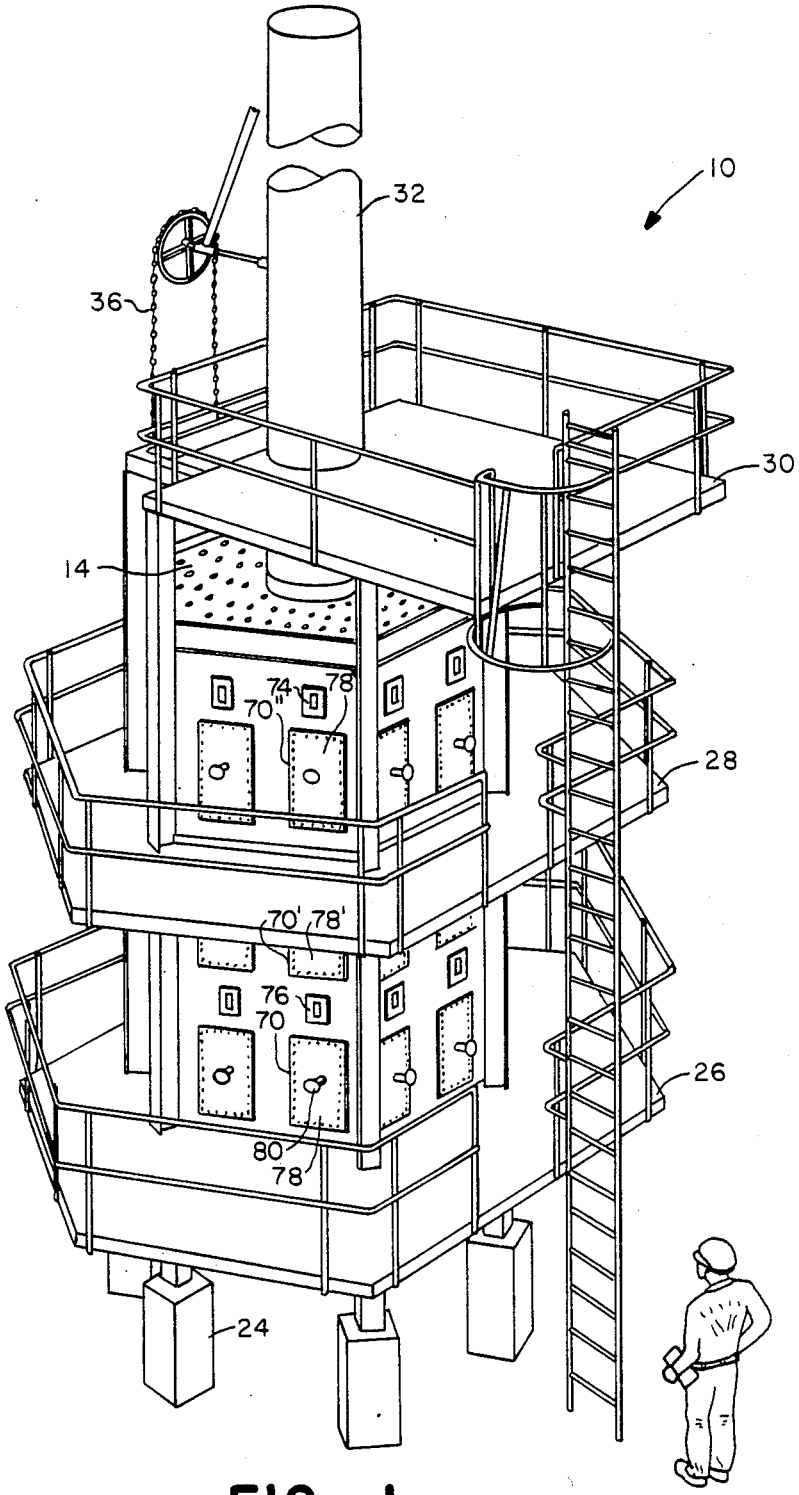
FIG. 1 is a perspective view of a fired heater constructed in accordance with one embodiment of the invention.
Figure 2:
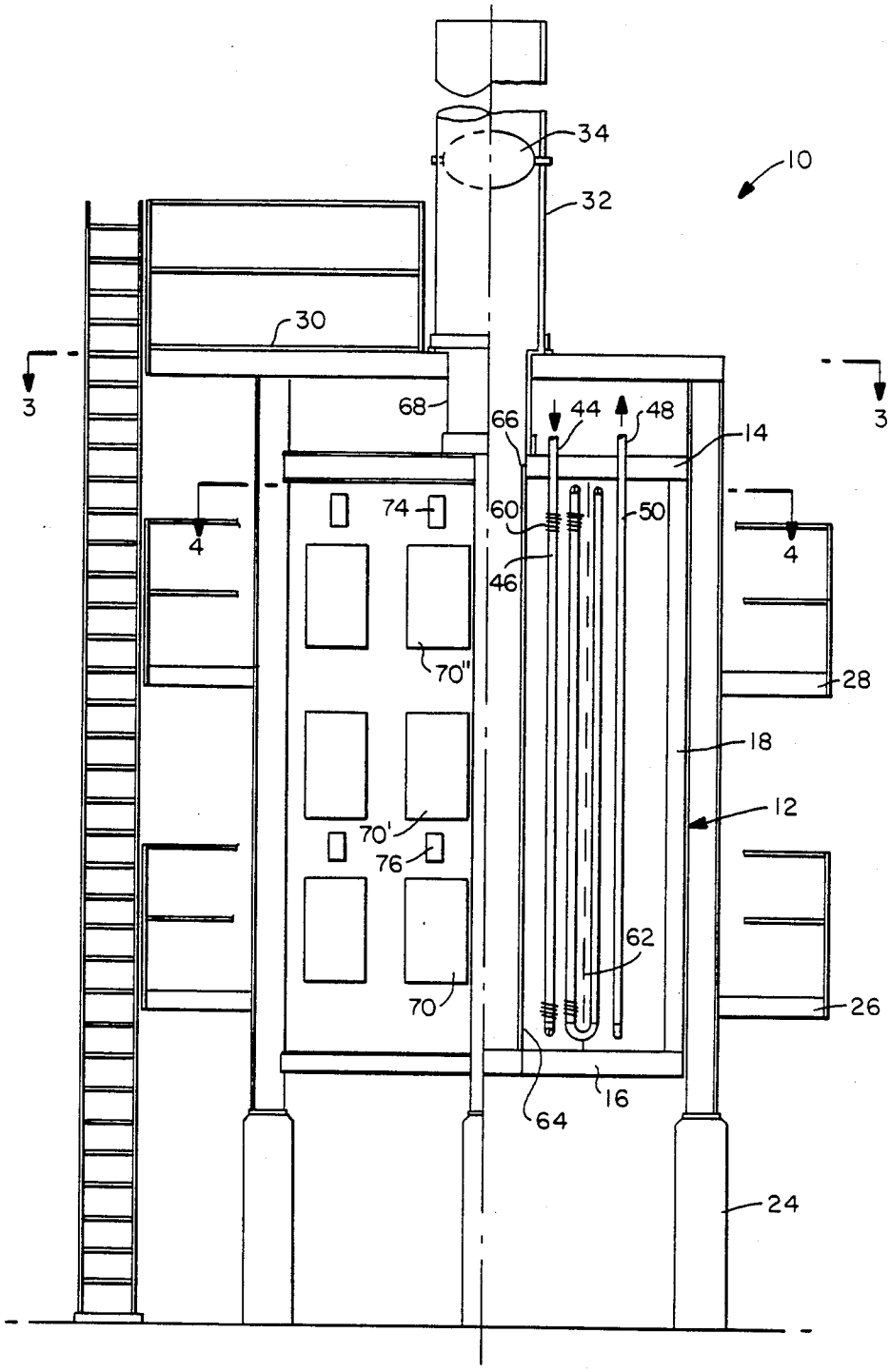
FIG. 2 is a vertical view, partially in axial section, of the heater of FIG. 1.
Figure 3:
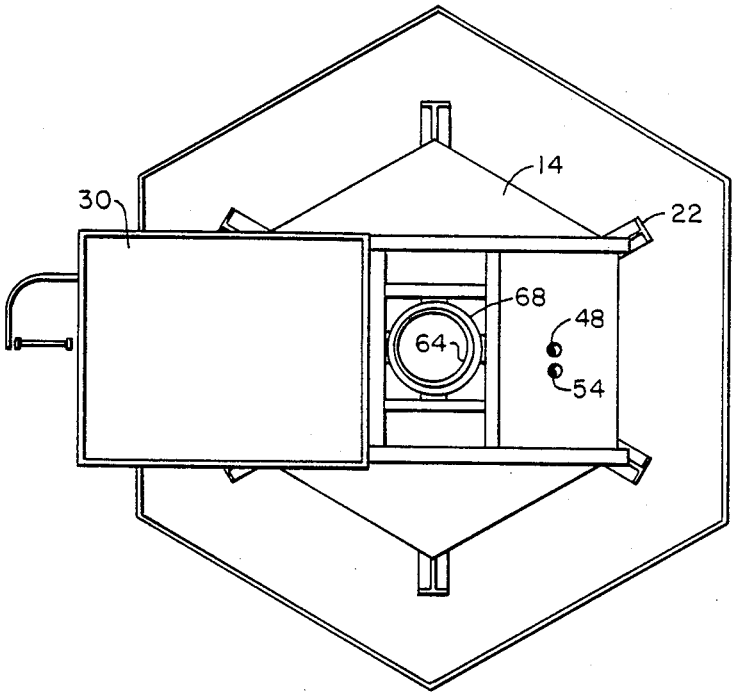
FIG. 3 is a cross-sectional view taken along the line 3—3 of FIG. 2.
Figure 4:
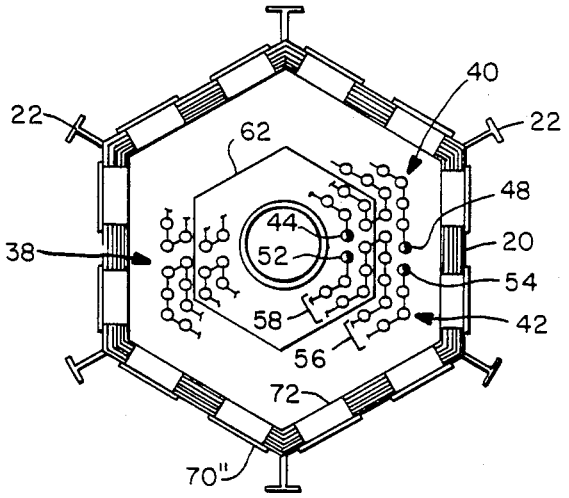
FIG. 4 is a cross-sectional view taken along the line 4—4 of FIG. 2.

In the drawings, FIGS. 1–4 illustrate one embodiment of the invention providing a fired heater 10 having a cylindrical combustion chamber 12 with concentric tube coil sections. The fired heater includes a roof 14, floor 16, and cylindrical side wall 18 which combine to define the combustion chamber. In the illustrated embodiment, the cylindrical side wall is of hexagonal cross-section, although other configurations such as rectangular or circular cross-section can be employed. The cylindrical side wall is comprised of slab walls 20 which are supported at their corners by upstanding structural beams 22. The beams are mounted above the ground by suitable foundation such as the piers 24. Two tiers of access walkways 26 and 28 are mounted about the side wall, and a platform 30 is mounted above the roof of the chamber for purposes of maintenance, repair and tube replacement. A flue 32 leads upwardly through the platform from the combustion chamber. Damper 34 is mounted in the flue for controlling the exhaust flow by means of damper control chain 36.

A vertical setting of a tube bundle 38 is suspended from the roof within the combustion chamber. In the illustrated embodiment, a compact hexagonal tube bundle is formed with two separate coil passes. One of the coil passes 40 forms the top half (as viewed in FIG. 4) of the tube bundle 38 while the other coil pass 42 forms the bottom half of the bundle. Each coil pass includes a plurality of tube rows, each row having a cylindrical shape generally commensurate with the shape of the side wall, for example, the tube rows are hexagonal in plan view for the illustrated embodiment. The first coil pass 40 is comprised of a plurality of vertical equal length tube runs serially connected through 180° elbows. The process inlet 44 for this bundle is at the top of tube run 46 at the end of the inner row while the outlet 48 is at the top of tube run 50 at the end of the outer row. The second coil pass 42 is similarly comprised of a plurality of equal length tube runs serially interconnected through 180° elbows, with the process inlet 52 at the top of the end tube of the inner row and the outlet 54 at the top of the end tube of the outer row.

The radiant section 56 of the tube bundle is formed by the outermost two rows of the coil passes, and the convection section 58 is formed by the innermost two rows so that the convection section is positioned concentrically within the radiant section. While the illustrated embodiment employs a two-coil pass inlet/outlet piping arrangement, other tube bundle designs could be employed such as one, three or six pass inlet/outlet arrangements.

In the radiant section, the two rows are formed by bare steel tubes which are laterally spaced apart to permit radial inward flow of gaseous products of combustion from the burners. The tubes of the two rows are staggered about the vertical axis to maximize their radiant view factors. The two innermost rows of the coil bundle which form the convection section are comprised of laterally spaced apart steel tubes which preferably are fitted with metal fins 60 to increase their heat absorption capabilities.

An optional convective shield 62 is provided between the radiant and convection sections where it is desired to provide uniform gas flow over the convection tubes and to protect the tube fins from direct radiant heat. In the illustrated embodiment convection shield 62 comprises a perforate metal cylinder of a hexagonal cross-sectional shape commensurate with the shape of the side walls and tube bundle. The shield is mounted concentrically between the rows of the tubes which form the two sections and serves to create a pressure drop in the gas flow to provide optimum vertical flow distribution into the convection section. In addition, the shield serves as a radiant reflector to heat the back sides of the outer two rows of tubes. Alternatively, the desired vertical flow distribution could be achieved by utilizing tightly finned tubes in the convection section in place of use of a shield. Horizontal baffles, not shown, could be mounted across the tube rows to maintain the desired radial gas flow, but such horizontal baffles are not required where the draft is sufficient and the spacing between the tubes and between the tubes and burners are properly selected to provide uniform radial flow with naturally-inspirated burner operation.

Means is provided for exhausting products of combustion from the chamber and may include a perforate vertical tube or sleeve 64 coaxially mounted within the convection section. The upper end of sleeve 64 is connected through an outlet port 66 in the roof, and the outlet port in turn is connected through an adaptor ring 68 with flue 32.

The radiant burner means in the side wall comprises a plurality of radiant burner units, preferably of flat plate burner configuration. In the illustrated embodiment, three vertical tiers of burner units 70, 70' and 70'' are provided. Each tier includes two adjacent burner units in each slab wall 20 with a resulting twelve units in each tier and thirty-six units for the entire heater. The slab walls are comprised of high temperature insulation 72, preferably ceramic fiber blankets of a thickness on the order of six inches, with the burner units mounted through openings formed in the insulation. Mounting of the burner units in the combustion chamber side wall eliminates a part of the wall insulation thereby reducing the weight of the wall as compared to conventional fired heaters. Peek doors 74 and 76 are mounted in openings formed through the insulation above the burners in the upper and lower tiers. The roof and floor are also comprised of high temperature insulation material, preferably ceramic fiber blankets for the roof and ceramic block insulation for the floor.

Optimum results are achieved in the invention by utilizing burner units which are comprised of a porous layer of ceramic fibers adapted to flamelessly combust premixed gaseous fuel and air which diffuses through the layers. Preferably the composition and method of formulation of the porous layers is in accordance with U.S. Pat. No. 3,383,159 issued to Smith and now assigned to Alzeta Corporation. Preferably the porous layer is vacuum-formed from a special slurry composition of ceramic fibers, binding agent and filler with the capability of being molded into various configurations, including the plate configuration for use in the present invention. Such a plate configuration would include a perforate metal support, not shown, upon which the ceramic fiber layer is molded following the procedures described in the Smith patent.

For each burner unit a rectangular section of the fiber layer with its support is mounted by suitable edge sealing means on the back side of reactant plenums 78, 78' and 78'' (FIG. 1). Inlet ports 80 in the plenums are connected through manifold piping and control valves (not shown) for directing premixed gaseous fuel and air into the burner units. Following ignition, operation of the ceramic burner units is characterized in that combustion takes place flamelessly and uniformly at about 1800° F. on the inner surfaces of the fiber layer which face the tube coils of the radiant section. The incandescent, hot surface of the fiber layer transfers most of the burner's heat input directly by thermal radiation to the opposing heat sink which is comprised substantially of the radiant section tubes. The low conductivity of the fibers, as well as the conductive cooling from the incoming flow of reactants, allows the burners to operate safely without flashback at surface velocities below the mixture flame speed. These burner units are further characterized in operating at very low excess air levels and with low pressure drop. The units turn on and off instantly, they are noiseless in operation and are not susceptible to thermal shock. Due to the low combustion temperature of the fiber layer burners, the resulting $NO_x$ emissions are less than 15 ppm and also with low emissions of CO and hydrocarbons. The fiber burners further operate at a heat release rate per unit area of burner surface on the order of 100,000 Btu/hr-ft$^2$. Because the heat input is based on surface area, the burners are scalable for different heater applications, and the individual burner units can be sized with heat release rates of from 15,000 Btu/hr up to $10\times10^6$ Btu/hr.

Other forms of radiant burner designs could also be employed in the invention. One such optional burner design is the flame impingement radiant burner type in which the combustion flame incandescently heats a non-porous ceramic layer which radiates heat to the process tubes.

Figure 5:
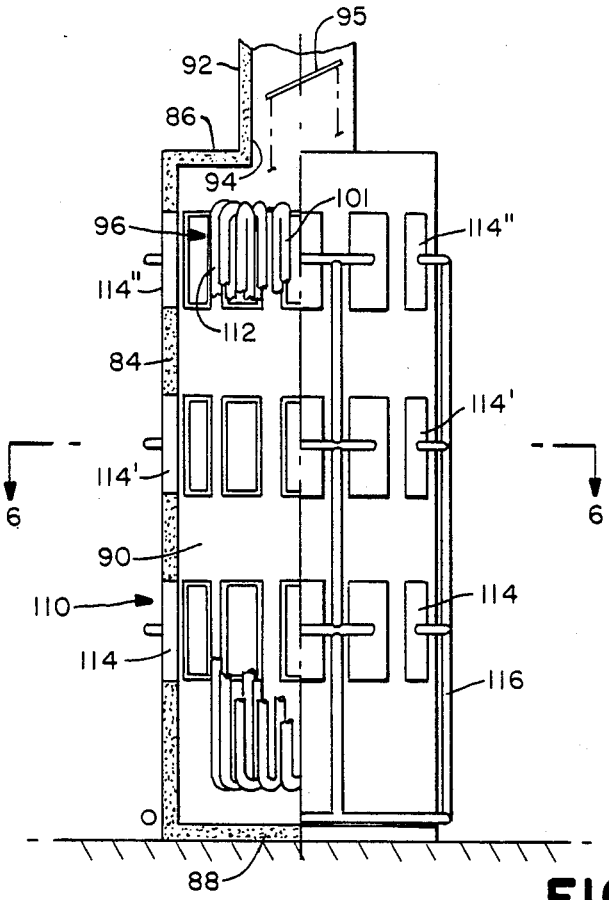
FIG. 5 is a vertical sectional view of a fired heater constructed in accordance with another embodiment of the invention.
Figure 6:
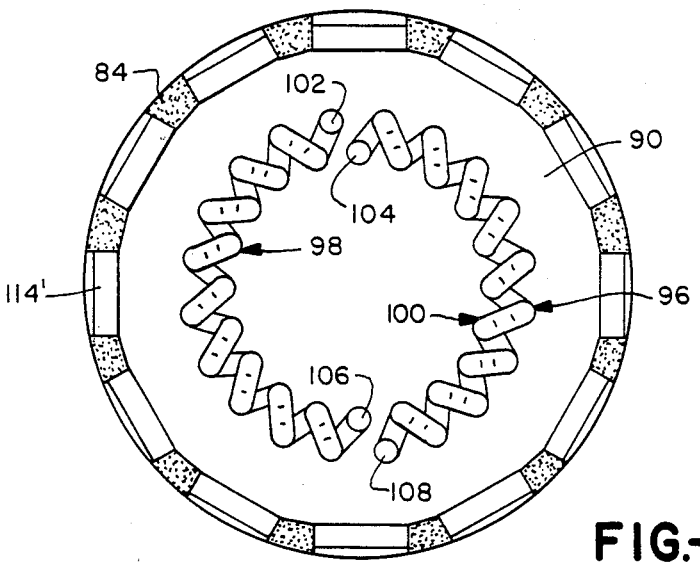
FIG. 6 is a cross-sectional view to an enlarged scale taken along the line 6—6 of FIG. 5.

Another embodiment of the invention illustrated in FIGS. 5 and 6 comprises a fired heater 82 of the "all radiant" design which is characterized in not employing a separate convection section. Heater 82 comprises a cylindrical wall 84, shown as circular in cross section, roof 86 and floor 88 which in combination define combustion chamber 90. A flue 92 extends upwardly from an exhaust port 94 in the roof and a damper 95 is mounted in the flue to control exhaust flow.

A vertical setting tube coil bundle 96 is suspended within the chamber by suitable means, not shown, from the roof or floor. In the illustrated embodiment, the tube bundle is comprised of two coil passes 98 and 100, although a greater or lesser number of coil passes could be provided. The coil passes are semi-circular in plan view although other geometric arrangements may be preferable. Each of the passes is comprised of a plurality of vertical tube runs 101 serially interconnected by 180° elbows. The process inlet flow is connected to the coil passes through the upper ends of tubes 102 and 104, respectively, and the outlet flow is connected to the upper ends of tubes 106 and 108, respectively. In each of the passes the tubes form a pattern in plan view so that alternate tube runs are spaced-apart in an outer row of each coil pass and alternate tube runs are spaced-apart in an inner row. The tubes in the two rows are staggered to maximize their radiant view factors for receiving radiation from the radiant burner means 110 mounted on side wall 84.

Radiant burner means 110 comprises a plurality of the flat or convex plate burner units 114, 114' 114'' of the type described above for the embodiment of FIGS. 1–4. Premixed gaseous fuel and air are directed to the reactant plenums of the units by manifold piping 116 and control valves (not shown). The reactants preferably are supplied to the manifold piping under pressure from a venturi-type inspirator, not shown.

The side wall 84 of the heater includes a layer of suitable heat insulation material such as a ceramic fiber blanket through which openings are formed for mounting the burner units. The roof 86 of the chamber is also comprised of an insulating material such as the ceramic fiber blanket, and the floor 88 is comprised of an insulating material such as ceramic block insulation. The burner units are mounted in three tiers on the heater walls. Each tier includes twelve burner units, although the number and arrangement of burner units employed and the burner unit size and rating would depend upon the particular operating conditions, heat input requirements, and tube arrangement.

With the burner units in operation, combustion takes place flamelessly on the inner surfaces of the fiber layers with the substantial part of the burner's heat input transferring by thermal radiation to the tubes which form the radiant section. The products of combustion from the burner generally flow upwardly around the inner periphery of the chamber with inward circulation between the tubes progressing during the upward flow. Some residual heat is transferred to the tubes with the spent gases then exhausting from the chamber into a flue 92 which is centered coaxial with the chamber to influence a more radial flow component for the gases.

Figure 7:
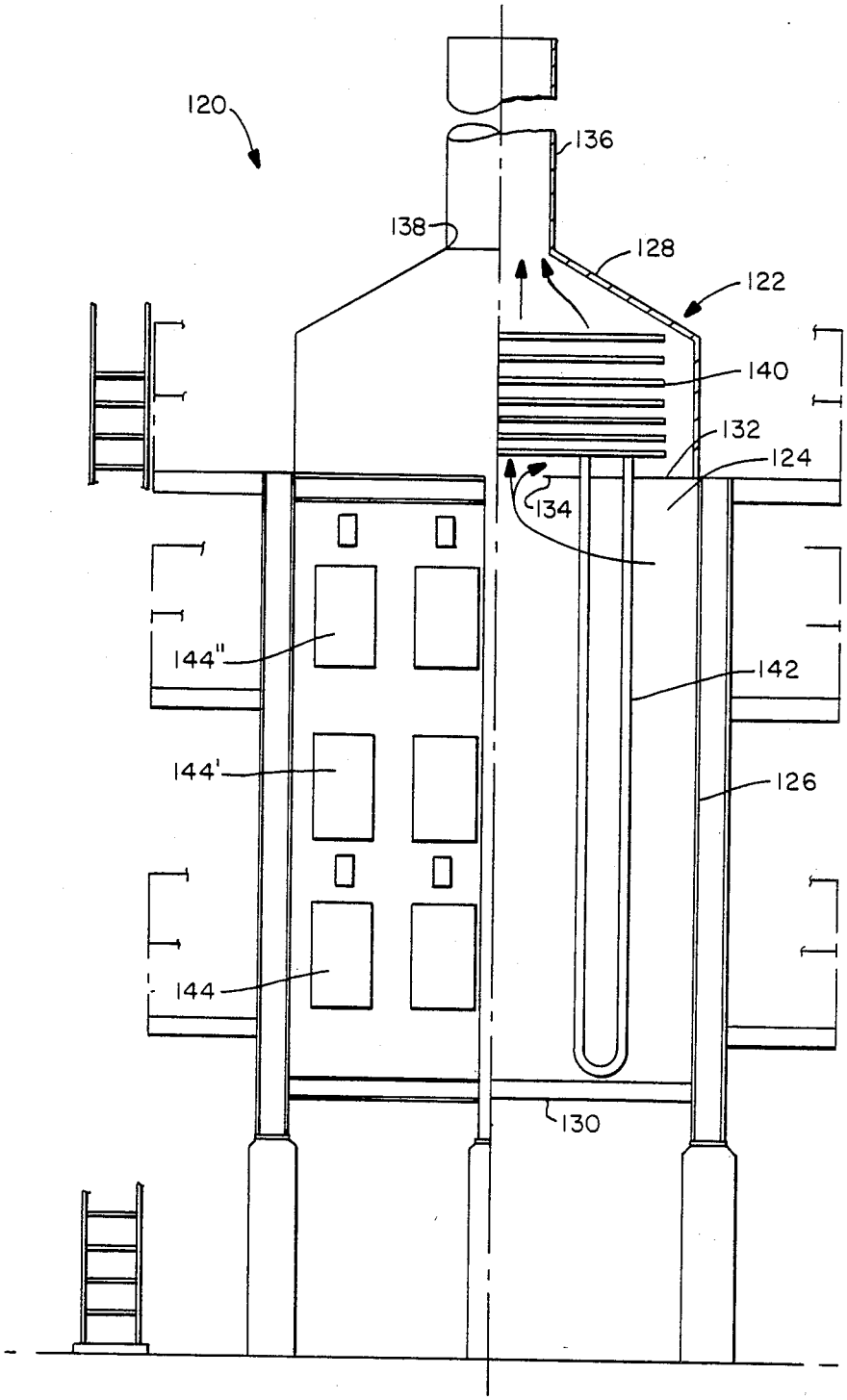
FIG. 7 is a vertical view, partially in axial section, of a fired heater in accordance with another embodiment of the invention.

In FIG. 7 another embodiment comprises fired heater 120 in which a convection section 122 is mounted above a radiant section 124 for increasing the thermal efficiency as compared to a heater design of the "all radiant" type. Fired heater 120 comprises a cylindrical wall 126, roof 128 and floor 130. A bulkhead 132 having a central port 134 is mounted across the upper end of the heater separating the radiant and convection sections. A flue 136 extends upwardly from an exhaust port 138 in the roof and a damper, not shown, can be mounted in the flue to control exhaust flow.

Within convection section 122 a horizontal setting tube coil bundle 140 is suspended by a suitable support means not shown. Within radiant section 124 a vertical setting tube coil bundle 142 is suspended by support means, not shown. Preferably radiant section tube bundle 142 is comprised of coil passes having a plurality of vertical tube runs serially interconnected in the manner explained for the embodiment of FIGS. 5 and 6. Inlet and outlet connections, not shown, are provided at opposite ends of the coil passes for directing the process flow through the tubes of the convection and radiant sections.

Heater side wall 126, roof 128 and floor 130 include layers of suitable heat insulation material of the type described for the embodiment of FIGS. 5 and 6. Openings are formed in the insulation of the side wall for mounting radiant burner means comprising a plurality of flat plate burner units 144, 144' and 144'' of the type described above for the embodiment of FIGS. 1–4. Three tiers of the burner units are provided, each tier including twelve units. Control valves and manifold piping (not shown) of the type described for the embodiment of FIGS. 1–4 is provided to direct premixed gaseous fuel and air to the reactant plenums of the units under pressure from a venturi-type inspirator.

In the use and operation of fired heater 120, the heat input from the burner units transfers primarily by thermal radiation to the tube coils of radiant section 124. The hot gas from the burners passes upwardly out of the radiant section through port 134 and into convection section 122. The gases flow in heat exchange relationship with the horizontal bundle of tubes in the convection section, and then are exhausted from the heater through flue 136.

One example of the use and operation of the invention is as follows. A fired heater as described for the embodiment of FIGS. 1–4 is constructed with the combustion chamber of hexagonal cross-section and with each side wall 20 of 8'-2⅜" width. The vertical setting tube bundles are formed into two coil passes with fifty-four tubes for each pass and with each tube run of 12'-6" straight pipe length. The two rows of tubes within the convection section are finned. Thirty-six porous fiber radiant flat plate burners are mounted in three tiers in the side walls. The burners are connected by manifolding through a venturi-type inspirator which supplies premixed reactants comprising air and process or natural gas. The inspirator is supplied with process or natural gas at a high pressure on the order or 20 psig. The burner surface area of each unit is $2.5' \times 1.4'$ giving a heat input of 350,000 Btu/hr. The total heat input for the fired heater is therefore approximately $12.6 \times 10^6$ Btu/hr, and with an estimated thermal efficiency of 80% the absorbed duty is $10 \times 10^6$ Btu/hr.

The premixed gaseous fuel and air are supplied through the manifold piping into the plenum of each burner unit 70, 70' and 70''. The reactants diffuse through the fiber layer and are ignited on the inner surfaces by a supplemental heat source such as a gas flame or igniter. Combustion takes place flamelessly along a shallow depth of the inner surfaces which reach an incandescent temperature on the order of 1,800° F. Thermal energy radiates to the tubes of the radiant section. The gaseous products of combustion from the burners flow inwardly between the radiant tubes and through the openings in the optional convection shield 62 into heat exchange relationship with the two inner rows of tubes which form the convection section. The exhaust gases are at a temperature on the order of 1,200° F. as they flow past the convection section. The gases then enter the central exhaust sleeve 64 and flow upwardly to exit the combustion chamber into flue 32 at a temperature on the order of 550° F. The desired process fluid such as Dowtherm feedstock is directed into the inlets of the two coil passes at a temperature on the order of 400° F. The feedstock circulates in counterflow with the exhaust gases to discharge from the outlets of the coil passes at a temperature on the order of 550° F.

The fired heater constructed and operated in accordance with the invention provides a number of improvements and advantages. In comparison to conventional fired heaters of equivalent heat input ratings, the heater of the present invention is more compact because the radiant and convection sections are combined in the combustion chamber, radiant heat transfer is not dependent on a large volume of hot gases, and the tubes can be mounted closer to the burners. The heater thereby is relatively smaller in size, of less weight and less expensive to construct. The provision in the invention of combining the radiant and convection sections into the combustion chamber facilitates tube removal from the top of the chamber with resulting economy for tube maintenance, repair and replacement. The configuration and placement of the tube bundles provides for uniform process fluid flow through tube runs of equal length and in turn achieves uniform high temperature about the periphery of the tubes and along the length of the runs.

In the invention, the wall-mounted radiant burners are more accessible for installation, removal and maintenance as compared to the floor-mounted burners of conventional heaters.

Operation of the fired heater employing the radiant burners of the invention enhances thermal efficiency. Heat transfer efficiency in the radiant section is enhanced because of greater reliance on radiation directly from the incandescent burner surface and with comparatively less reliance on radiation from the exhaust gas. As a result, the temperature entering the convection section will be lower as compared to that in a conventional fired heater, thereby decreasing the required heat exchanger surface. Thermal efficiency is also enhanced in that the radiant burners operate on relatively lower excess air as compared to the burners in conventional heaters.

Air pollution emissions are minimized utilizing radiant burners of the porous fiber layer construction as specified for the invention. Fiber burners of this type produce $NO_x$ on the order of only 20 ppm with low CO and hydrocarbon emissions at 10% excess air. This is in comparison to conventional heaters using burners firing gas and oil and which produce up to 100 and 150 ppm $NO_x$, respectively. In addition, conventional heaters utilizing such burners force a tradeoff between low $NO_x$ and low combustible emissions, especially under minimum excess air conditions.

Operation of the heater of the invention provides a range of turndown capability. The individual radiant burners can be selectively turned on or off; for example, the burners in each tier can be turned on or off to provide a 3:1 turndown ratio which is comparable to the turndown ratio of conventional heaters. As required, a wider turndown range can be obtained by controlling flow to the individual burners by up to 50%, thereby permitting an overall 6:1 turndown range. During operation, the radiant burners operate flamelessly with essentially no noise so that the severe combustion noise associated with conventional fired heaters is obviated, thereby decreasing the occupational hazard to plant personnel.

While the foregoing embodiments are at present considered to be preferred, it is understood that numerous variations and modifications may be made therein by those skilled in the art and it is intended to cover in the appended claims all such variations and modifications as fall within the true spirit and scope of the invention.

What is claimed is:

1. A fired heater comprising a vertical setting of a roof, a floor and a cylindrical sidewall which define a chamber, radiant burner means mounted in the sidewall for flamelessly combusting pre-mixed fuel and air with the burner means oriented to direct radiant heat inwardly of the chamber, at least one coil of tubes for containing fluid which is to be heated, the coils being mounted with tube runs which extend vertically within the chamber with portions of the tube forming a radiant section spaced inwardly from the burner means for absorbing radiant heat therefrom, said tube runs in the radiant section being circumferentially spaced apart to define channels for radial inward flow across the tubes of products of combustion from the burner means, and exhaust means for directing the products of combustion in an exhaust stream from the chamber.

2. A fired heater as in claim 1 in which the radiant section is in a cylindrical configuration, the side walls of the chamber define a vertically axised cylinder with the radiant burner means circumferentially disposed about the side walls and substantially encircling the radiant section.

3. A fired heater as in claim 2 in which the radiant burner means comprises a plurality of radiat burner units mounted in the side walls in at least one tier of circumferentially spaced apart burner units.

4. A fired heater as in claim 2 in which the radiant burner means comprises a plurality of flat or convex plate radiant burner units with each unit mounted in the side wall and in facing relationship with tubes of the radiant section.

5. A fired heater as in claim 4 in which the burner units are comprised of a porous layer of ceramic fibers and means for passing premixed fuel and air radially inwardly through the porous layer for flameless combustion on the inner surfaces of the layers.

6. A fired heater as in claim 1 which includes at least another coil of tubes forming a convection section mounted concentrically within the radiant section, said coils of the convection section comprising tube runs circumferentially spaced apart to define channels for radial inward flow across the convection section tubes of gaseous products of combustion from the burner means, and the exhaust means extracts products of combustion from within the convection section.

7. A fired heater as in claim 6 in which the tube runs which form the convection section extend vertically within the chamber.

8. A fired heater as in claim 7 which includes perforate convection shield means between the radiant and convection sections for maintaining a pressure drop in the flow of gases from the radiant section to the convection section for optimum vertical distribution of the radial flow of gases into the convection section.

9. A fired heater as in claim 7 in which the exhaust means includes a perforate cylindrical sleeve coaxially mounted inside of the convection section with the upper end of the sleeve connecting through the roof for exhausting the products of combustion from the chamber.

10. A fired heater as in claim 6 which includes heat absorption fins mounted externally on the tubes of the convection section.

11. A fired heater as in claim 1 in which the burner means is circumferentially positioned about a lower portion of the chamber and further including at least one coil of tubes forming the convection section mounted above the radiant section, said tubes in the coil forming the convection section being spaced-apart to define channels for the flow across the convection section tubes of products of combustion, and means for directing the products of combustion from the burners along a path upwardly from the radiant section into the convection section in heat exchange relationship with the convection section coil of tubes and through the channels therebetween.

12. A fired heater as in claim 11 in which the burner means comprises a plurality of radiant burner units with the units mounted in at least one tier in circumferentially spaced-apart relationship about the lower portion of the side wall.

13. A fired heater as in claim 12 in which the burner units comprise flat plate radiant burners.

14. A fired heater as in claim 13 in which the radiant burners are comprised of a porous layer of ceramic fiber and means for passing premixed fuel and air radially inwardly through the fiber layer for flameless combustion on the radially inner surfaces of the layers.

15. A fired heater for heating fluids comprising a vertical setting with a roof, a floor and a cylindrical side wall defining a combustion chamber, radiant burner means mounted in the side wall for flamelessly combusting premixed fuel and for radiating heat into the chamber, at least one radiant coil section comprising a plurality of spaced-apart tubes vertically suspended within the chamber with the radiant coil tubes positioned inwardly of the burner means for absorbing the radiating heat, exhaust means positioned centrally of the chamber for directing gaseous exhaust products from the burners in a flow radially inwardly and thence exhausting from the chamber, and at least one convection coil section comprising a plurality of spaced-apart tubes vertically suspended within the chamber inwardly of the radiant coil section and in heat exchange relationship with the radially inward flow from the burners.

* * * * *